United States Patent [19]

Heine et al.

[11] 4,101,724

[45] Jul. 18, 1978

[54] FURNACE CONVERSION METHOD AND APPARATUS

[75] Inventors: Hans Gunther Heine, Little Silver; Otto Hochstrasser, North Brunswick, both of N.J.; Fritz Hegewaldt, Herdecke, Fed. Rep. of Germany

[73] Assignee: Brown Boveri Corporation, North Brunswick, N.J.

[21] Appl. No.: 701,013

[22] Filed: Jun. 30, 1976

[51] Int. Cl.[2] ..... F27D 11/02; H05B 3/06; H05B 3/40

[52] U.S. Cl. ..... 13/1; 13/25

[58] Field of Search ..... 13/1, 2, 20, 25; 219/300

[56] References Cited

U.S. PATENT DOCUMENTS

| | | | |
|---|---|---|---|
| 383,536 | 5/1888 | Newman | 219/300 |
| 3,518,351 | 6/1970 | Ohnsorg et al. | 13/20 X |

*Primary Examiner*—R. N. Envall, Jr.

*Attorney, Agent, or Firm*—Fitzpatrick, Cella, Harper & Scinto

[57] ABSTRACT

A controlled atmosphere furnace having radiant heating tubes, through which hot gases from a fuel burner are passed, is converted to electrical operation by removing the fuel burner and exhaust connections from the heating tubes and replacing these with electrical connector extensions connected to an electrical power source so that electrical current is driven longitudinally through the heating tube walls and converted therein to heat which is radiated into the furnace enclosure.

4 Claims, 11 Drawing Figures

GAS BURNER
46
48
42
44
34
30
50
52
53
36
22
20
38
40
28

GAS BURNER
46
24
42
44
A
A
52
36
38
26
40

FURNACE CONVERSION METHOD AND APPARATUS

BACKGROUND OF THE INVENTION

1. Field of the Invention

This invention relates to controlled atmosphere furnaces and more particularly it concerns novel arrangements whereby a fuel-fired radiant tube type controlled atmosphere furnace is adapted to electrical operation.

2. Description of the Prior Art

Controlled atmosphere furnaces are used primarily for heat treating and annealing. These furnaces are usually heated by the hot combustion products from a gas or oil burner positioned outside the furnace. These combustion products are recirculated through radiating tubes mounted inside the furnace; and the radiating tubes isolate these combustion products from the atmosphere within the furnace.

Fuel-fired industrial furnaces are often unsatisfactory from the standpoint of noise and pollution. Also, the radiating tubes in these furnaces sometimes develop "hot spots" due to improperly adjusted burners, which reduce the useful life of the radiant tubes.

In order to avoid these difficulties without completely replacng still functional furnaces, attempts have been made to convert existing fuel-fired radiant tube furnaces to electrical power. This was done by providing electrical resistance elements, e.g., silicon carbide elements, spirally wound wire, folded or corrugated or expanded strips; and mounting these elements inside the existing furnaces. Problems were encountered, however, due to the difficulty of properly supporting the electrical heating elements inside such furnaces without almost rebuilding the entire furnace. The heating elements were also subject to frequent breakage or short circuiting.

Other electrical heating elements which have been used in furnaces or ovens comprise electrical resistance elements which are supported on a dielectric material such as ceramic. The dielectric material in turn is encased in a radiating cover, usually made of metal. These heating elements however, are expensive to manufacture and they do not provide sufficient heat radiating capability for many applications, because of the temperature gradient between the actual heating wire and the radiating cover.

SUMMARY OF THE INVENTION

The present invention avoids the above described disadvantages of the prior art.

According to one aspect of the invention, there is provided a novel method by which a fuel-fired radiant tube type furnace is converted economically and effectively. This novel method is carried out by first disconnecting the radiant tubes of the furnace from the external burner and from the burner exhaust. Electrical terminals are then secured to each end of the furnace tubes and a high current electrical power supply is connected to the terminals to cause electrical current to be driven longitudinally through the tube walls. The tube walls thus serve the dual function of conducting the electrical current and of radiating the heat generated by the current flow through them. Thus the radiator element essentially remains the same as in the fuel fired furnace and only the energy source is changed. Further the ease of replacement of a radiating element is maintained.

According to another aspect of the present invention, there is provided a novel electrically powered furnace comprising a furnace enclosure and a plurality of electrically conductive tubular heating elements mounted within the enclosure. The ends of the heating elements extend out through the furnace walls and are connected to external electrical power supply means. Electrical current from the power supply means is passed longitudinally through the tube walls to heat the tubes; and in turn this heat is radiated into the furnace enclosure.

There has thus been outlined rather broadly the more important features of the invention in order that the detailed description thereof that follows may be better understood, and in order that the present contribution in the art may be better appreciated. There are, of course, additional features of the invention that will be described more fully hereinafter. Those skilled in the art will appreciate that the conception on which this disclosure is based may readily be utilized as the basis for the designing of other arrangements for carrying out the several purposes of the invention. It is important, therefore, that this disclosure be regarded as including such equivalent arrangements as do not depart from the spirit and scope of the invention.

BRIEF DESCRIPTION OF THE DRAWINGS

A single embodiment of the invention has been chosen for purposes of illustration and description and is shown in the accompanying drawings forming a part of this specification, wherein.

DETAILED DESCRIPTION OF THE PREFERRED EMBODIMENT

Since the present invention is primarily applicable to the conversion of prior art gas fired controlled atmosphere furnaces, a brief description of a typical prior art gas fired furnace will first be given.

Figure 1:
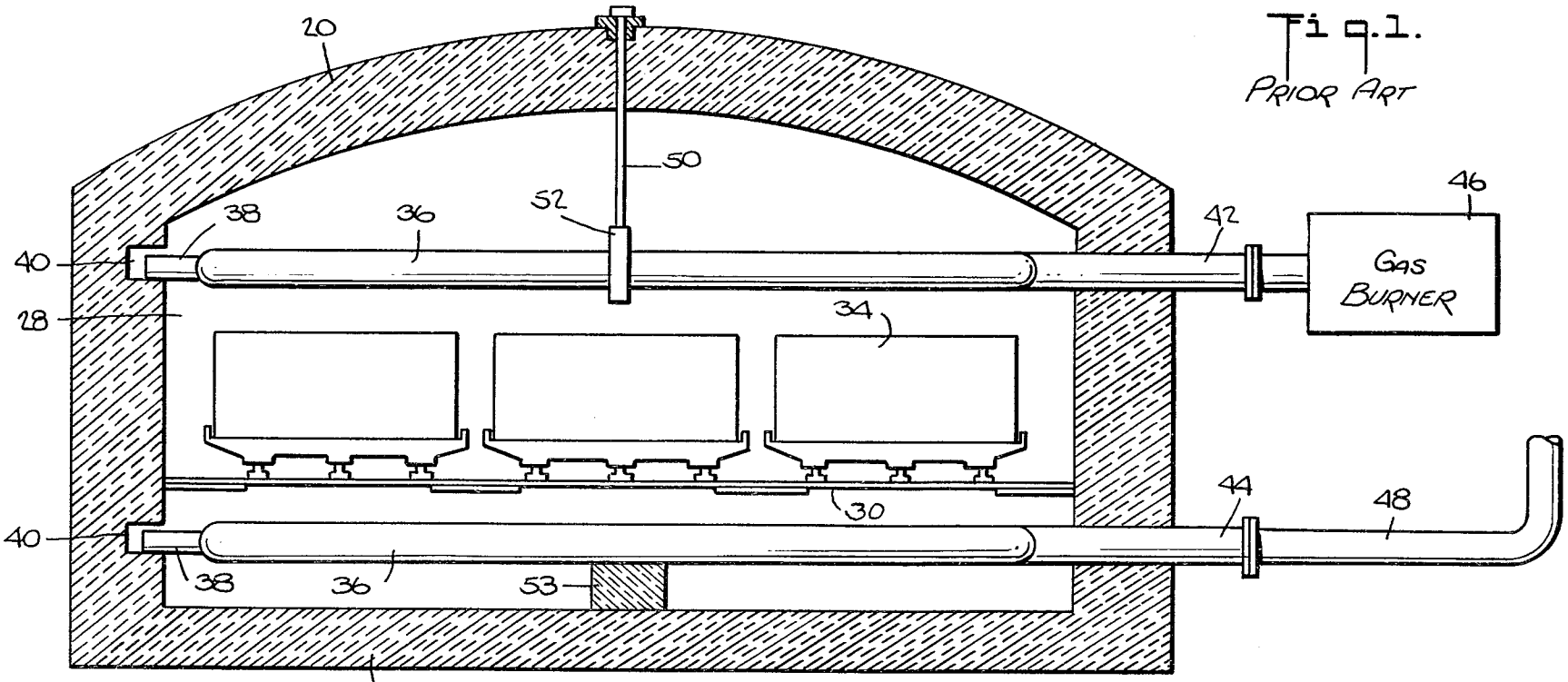
Fig. 1. PRIOR ART
FIG. 1 is an elevational cross section view of a gas fired, controlled atmosphere furnace according to the prior art.

The prior art gas fired controlled atmosphere furnace of FIG. 1 is made up of top and bottom walls 20 and 22, side walls 24 and 26, and end walls (not shown) defining an enclosed treatment region 28. The various furnace walls are of conventional construction and they are made up of a heat insulative material such as a refractory brick. Supporting racks 30 extend across the treatment region 28 and are supported at the side walls 24. Pallets 32 rest on the racks 30; and workpiece bins 34 are carried on these pallets. Door means (not shown) are provided at the end walls for positioning the pallets and bins inside the treatment region 28 and for withdrawing the pallets and bins after treatment. Workpieces, for example, metal parts to be heat treated, are carried in the bins 34. These workpieces are exposed in the treatment region 28 to a carefully controlled temperature and atmosphere for a predetermined length of time to produce desired metallurgical effects.

Figure 2:
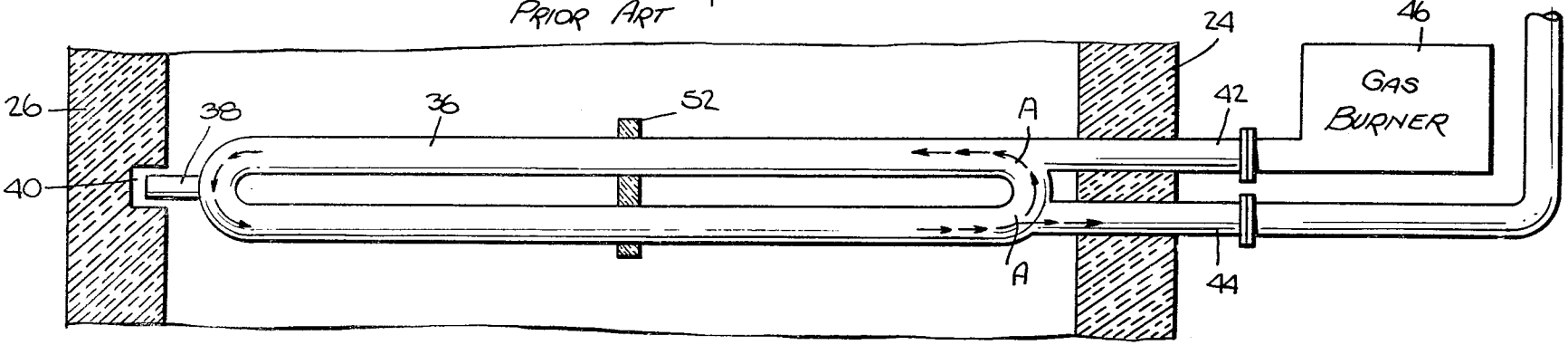
Fig. 2. PRIOR ART
FIG. 2 is a fragmentary section view taken along line 2—2 of FIG. 1.
Figure 3:
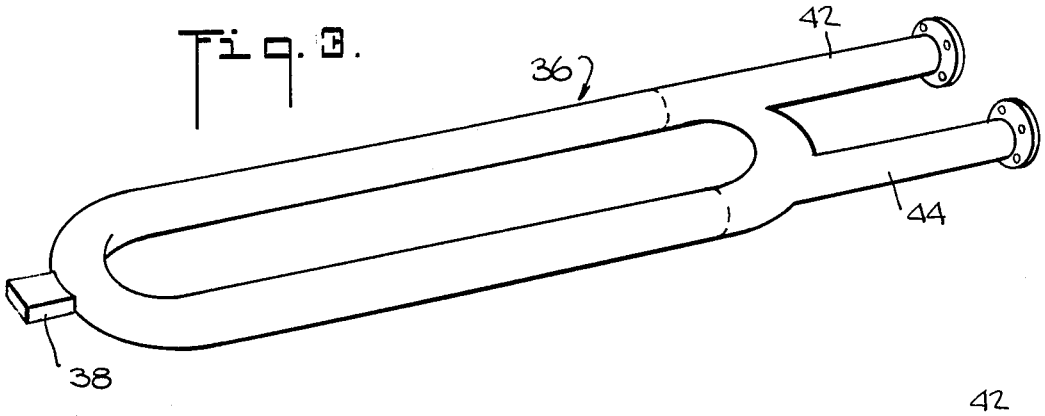
FIG. 3 is a perspective view of a typical gas fired heating tube used in the furnace of FIG. 1.

As can be seen in FIGS. 1 and 2 there are provided a number of gas fired heating tubes 36 which extend across the interior of the furnace between the side walls 24 and 26, both above and below the bins 34 and the racks 30. Several such heating tubes may be distributed along the length of the furnace interior; however for clarification only a single upper and lower heating tube will be described herein.

The heating tubes 36, as shown in FIG. 2, are each formed into an elongated recirculating loop. One end of the loop is provided with a support bracket 38 which extends into a niche 40 cut into the furnace side wall 26. The opposite end of the heating tube loop is provided with intake and exhaust headers 42 and 44 which extend from either side of the curved end of the loop and out through the furnace wall 24. A gas burner 46 is connected to fire hot gases into the intake header 42 while an exhaust stack 48 is connected to direct spent gases out through the exhaust header 44. In many instances the recirculating portion of the heating tube loop is omitted and the burner gases pass once around the loop and are exhausted directly thereafter. The present invention is equally applicable to heating tubes of this type.

In operation of the furnace shown in FIGS. 1 and 2, the bins 34, containing workpieces to be treated, are moved, either continuously or batchwise, through the treatment region 28 of the furnace. During the time that the workpieces are in the treatment region, the gas burner 46 for each of the heating tubes 36 is fired into its associated intake header 42. The hot flaming gases from the burner 46 pass through the tube 36 across the interior of the furnace and back again. A portion of the gases recirculate in the heating tube (as indicated by the arrows A), while the remainder pass out through the exhaust header 42 to the exhaust stack 48. The hot gases inside the heating tubes 36 heat the tube walls to a very high temperature. This heat is conducted through the tube walls and is radiated therefrom into the treatment region 28. It will be noted that none of the gases from the gas burner 46 pass into the treatment region itself and the treatment region may be maintained under very closely controlled atmospheric conditions.

The heating tubes 36 in most atmospherically controlled heat treatment furnaces are made of a high temperature alloys. These alloys are capable of withstanding high furnace temperatures without appreciable corrosion or loss of strength. Many types of high temperature alloys have been used. One typical alloy contains 26% chromium and 20% nickel. Of course the present invention is not limited to use with any particular composition of alloy in the heating tubes. In order to provide adequate passageway for free flow of burner gases and to provide adequate surface area for heat radiation the heating tubes have to be of suitable diameter and wall thickness. The heating tube length between the furnace side walls in the illustrative embodiment is about three meters. It will be appreciated however that the present invention is applicable to furnaces and heating tubes of other dimensions. In most instances the diameter of the heating tubes provides sufficient beam strength to enable the tubes to extend across the treatment region without bending under their own weight. However, in order to ensure that the upper tubes will not sag down too close to the bins 34 there is provided a hanger 50 which extends down from the center of the top wall of the furnace to support the middle region of the upper tubes. A hanger bracket 52 fits around the tubes and connects them to the hanger. The lower tubes are similarly supported at the center thereof by means of refractory bricks 53.

Figure 4:
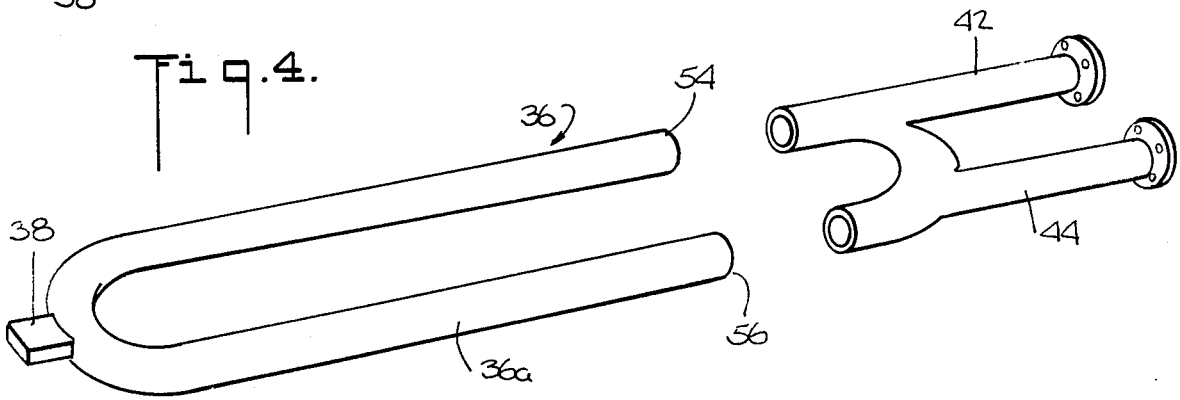
FIG. 4 is a view similar to FIG. 3 but showing a first step in a furnace conversion method according to the present invention.
Figure 5:
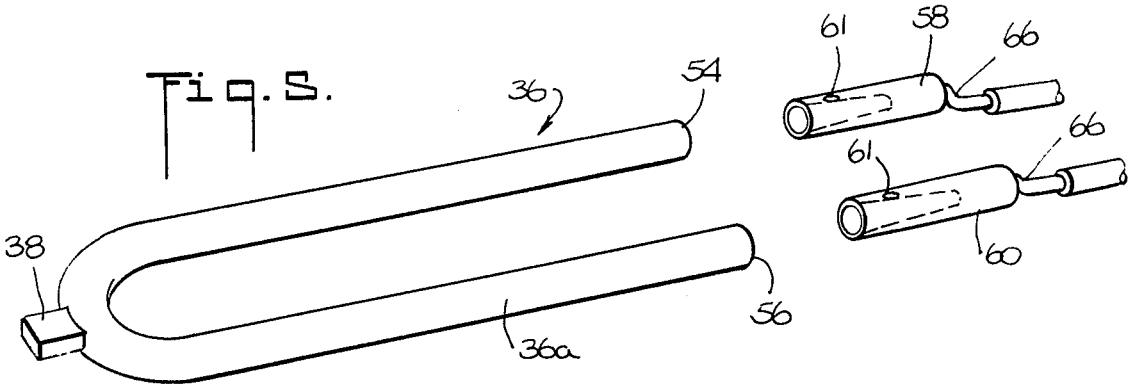
FIG. 5 is a view similar to FIG. 4 but showing a second step in a furnace conversion method according to the present invention.
Figure 6:
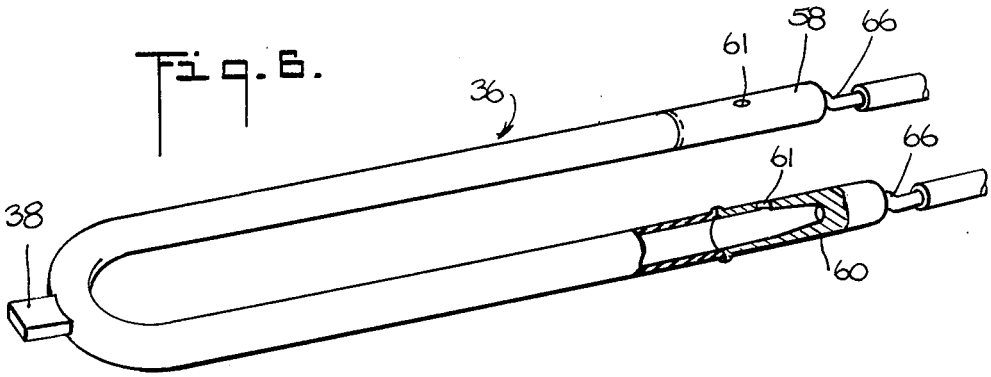
FIG. 6 is a view similar to FIG. 5, but showing a third step in a furnace conversion method according to the present invention.

The above described gas fired furnace of the prior art is converted, according to the present invention, to electrical power in the manner shown in FIGS. 4–6. As shown in FIG. 4 one of the heating tubes 36 is removed from the furnace and the end of the tube containing the intake and exhaust headers 42 and 44 is cut off along with the curved recirculating portion between the headers. The location of this cut is just inside the furnace wall when the tube is in place within the furnace. This leaves a main U-shaped portion 36a having two open ends 54 and 56. Thereafter, as shown in FIG. 5, a pair of connector extensions 58 and 60 are positioned to replace the intake and exhaust headers; and, as shown in FIG. 6, the connector extensions are connected by welding or other means to the open ends 54 and 56 of the heating tube 36. All of the heating tubes 36 are modified in a similar manner; and they are then positioned back in the furnace as shown in FIGS. 7 and 8.

Figure 7:
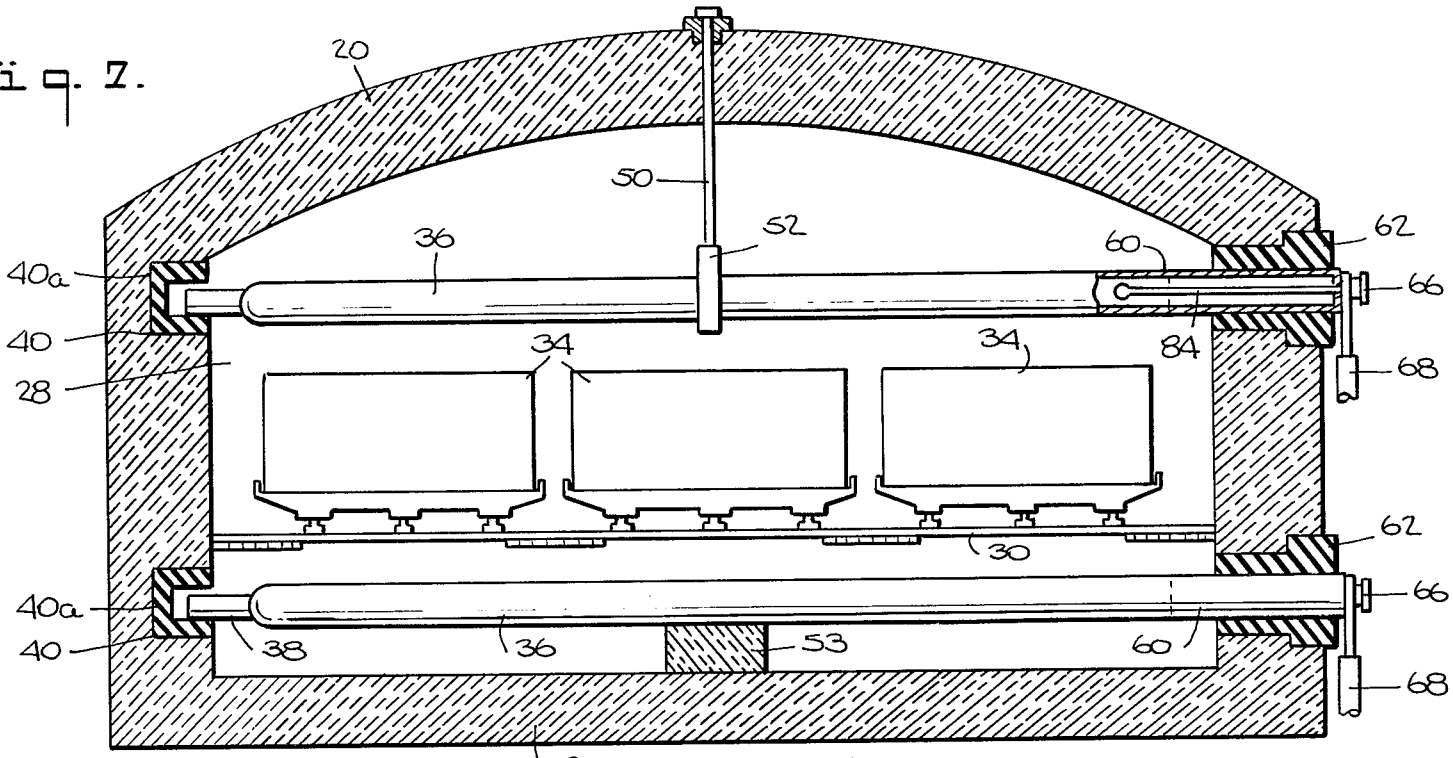
FIG. 7 is an elevational cross section view of an electrically powered controlled atmosphere furnace according to the present invention.
Figure 8:
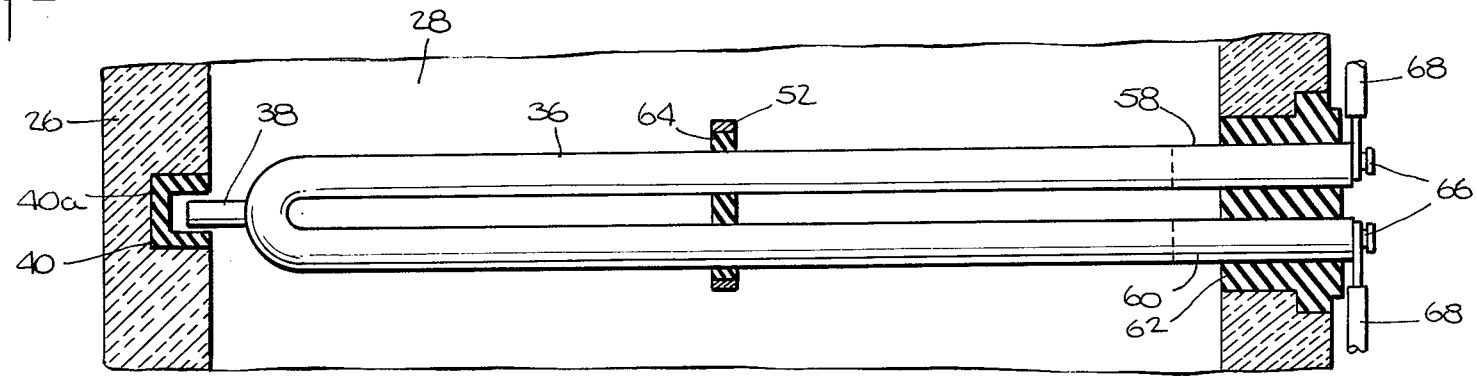
FIG. 8 is a fragmentary section view taken along line 8—8 of FIG. 7.

It will be noted in FIGS. 7 and 8 that the niche 40, into which the support bracket 38 extends, is provided with an electrically insulative lining **40*a*, and that the furnace wall 24, through which the connector extensions 58 and 60 extend, is also provided with electrically insulative bushings 62 surrounding these extensions. In addition, the bracket 52, which supports the center region of the upper heating tubes, is also provided with an electrically insulative liner 64** in contact with the tubes.

Figure 10:
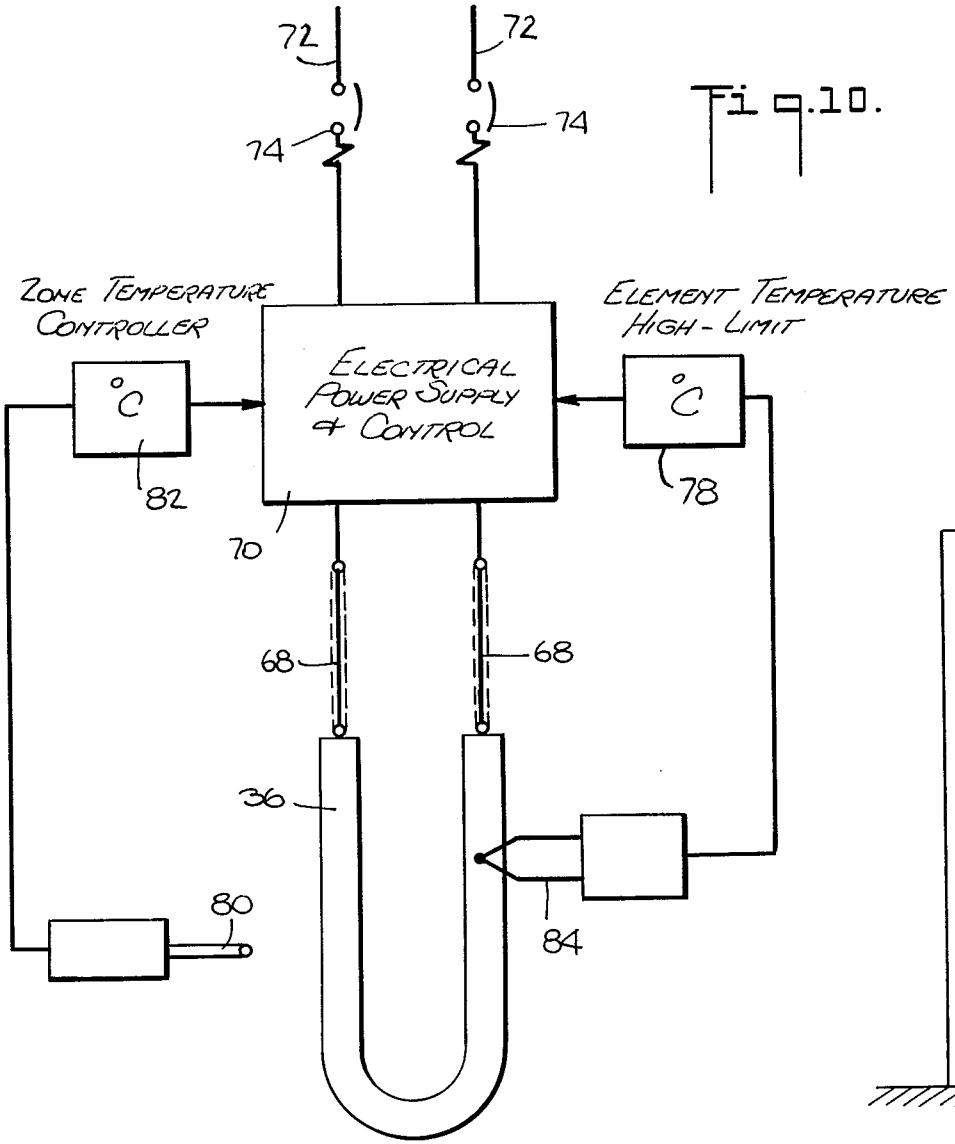
FIG. 10 is an outline view showing the overall structural arrangement of the furnace of FIG. 7 with its electrical power supply.

The outer end of the connector extensions 58 and 60, i.e. outside the furnace wall 24, are provided with electrical terminals 66 to which are connected electrical power supply cables 68. As shown in FIG. 10 the cables 68 are arranged to interconnect the heating tubes 36 to the output of an electrical power supply and control 70 such as a variable reactance transformer. Various circuit arrangements may be provided for the supply of electrical current to the tubes 36 so long as each tube is connected in a manner such that electrical current is driven longitudinally through the tube walls from one of its connector extensions 58, 60 to the other.

The electrical power supply and control 70 may be a conventional single phase transformer capable of stepping down a high voltage input, e.g., four hundred eighty volts, to a low voltage output, e.g. fifty volts. The transformer may be adjustable in the usual way to control the output voltage which in turn varies the current flow through the heating tubes and correspondingly varies their temperature. Alternating current electrical input power is supplied from an external electrical power source (not shown) via input lines 72 to the electrical power supply and control 70. Fuses or circuit breakers 74 are provided in the input lines 72 to protect the system against short circuits.

A zone temperature probe 80, such as a thermocouple, is provided in the furnace among the heating tubes 36 and this temperature probe is connected to a zone temperature controller 82 which adjusts the electrical power supply and control 70 to increase its output current when the temperature within the treatment region falls below a preset level, and to decrease the output current when the treatment region temperature exceeds a preset level.

A heating tube temperature probe 84 is provided in association with each of the heating tubes 36 to measure their temperature. Each probe 84 is connected to an associated heating tube temperature controller 78 which also adjusts the electrical power supply and control 70 to maintain the temperature of the corresponding heating tube 36 within predetermined limits. As shown in FIG. 7, the heating tube temperature probe 84 extends through the transition element 58 to a location inside the heating tube 36 to sense the temperature of that portion of the heating tube within the treatment region.

Figure 11:
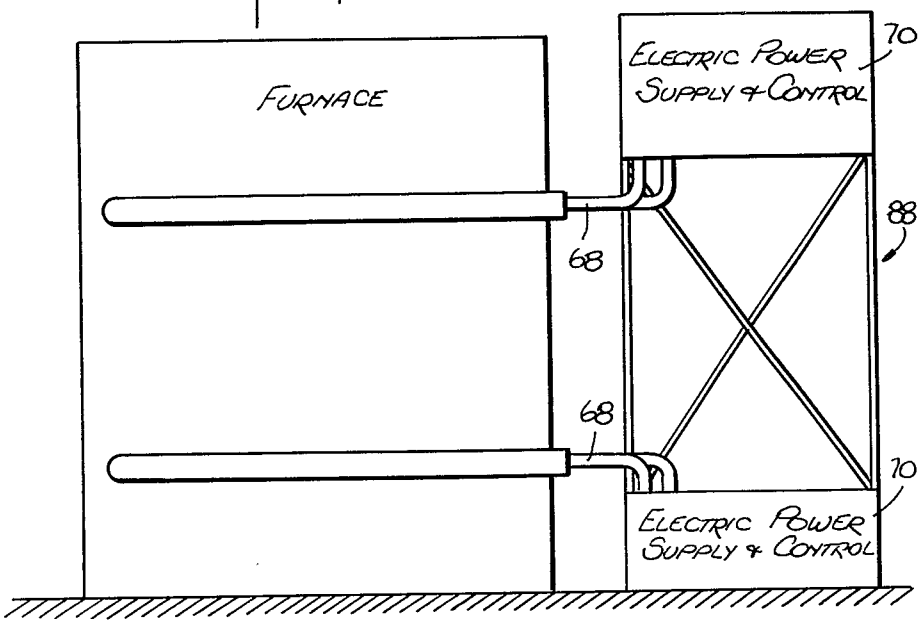
FIG. 11 is a fragmentary perspective view showing a further modification of the furnace heating tubes of FIG. 3.

Turning now to FIG. 11, it will be seen that the electrical power supply and controls 70 for various ones of the heating tubes 36 are mounted on an supporting structure 88 adjacent the furnace. The cables 68, which extend from the power supply and control to the heating tubes, are preferably water cooled.

Separate electrical power supply and control systems may be positioned along the supporting structure 88 with different transformers connected to supply electrical current to different heating tubes along the furnace. In this manner different zones within the treatment region of the furnace can be separately temperature controlled. Electrical bus lines (not shown) are carried by the supporting structure to supply electrical power to the various power supply and control systems.

Reverting now to FIGS. 5 and 6, it will be seen that the connector extensions 58 and 60 have a generally cylindrical outer configuration. These extensions, however, taper internally from a tubular shape, at the end connected to their respective heating tubes 36, to a solid shape at the end connected to the electrical terminals 66. This tapering serves to decrease the conductor cross section through which current from the electrical power supply and control flows. Because of this, the current density along the walls of the tubes 36 is higher than in the connector extensions 58 and 60; and, accordingly, the tubes 36 become heated to a higher temperature than connector extensions.

The connector extension 58 and 60 are also provided with vent openings 61 which communicate between the interior of the tubes 36 and the interior of the furnace treatment region 28. Whereas the interior of the tubes was previously isolated from the interior of the furnace for gas firing operation; the tubes are instead isolated from the exterior of the furnace and are in communication with the interior of the furnace for electrical operation. This communication, which is achieved by means of the vent openings 61, ensures that no pressure buildup will take place within the tubes 36 due to high temperatures. It will be appreciated that vent openings may be provided at any other location along the tubes 36.

In operation of a furnace which has been converted as above described, pallets 32 and bins 34 containing workpieces to be treated are positioned in the treatment region 28 in the usual manner. The electrical power supply and control is then energized so that electrical current flows from it, through the cables 68, the convertor extensions 58 and 60 and longitudinally through the walls of the heating tubes 36. The tube walls thereupon convert this electrical current to heat; and at the same time they radiate this heat directly into the treatment region 28. The temperature within the treatment region is sensed by the zone temperature probe 80 and the probe output is used to cause the zone temperature controller 86 to adjust the output current from the electrical power supply and control 70. In this manner the heat produced by the heating tubes is controlled to maintain a predetermined temperature within the treatment region 28.

In a typical installation the heating tubes 36 may be required to conduct many thousand amperes of current and to sustain very high temperatures. The alloys employed in most gas fired heating tubes are usually quite adequate to handle these high electrical currents and temperatures without degradation of structural properties or electrical characteristics.

The heating tube temperature probe 84, as explained above, serves to control current flow through each tube, and therefore its temperature. This protects the heating tubes from being heated to a temperature at which they begin to lose structural integrity.

Figure 9:
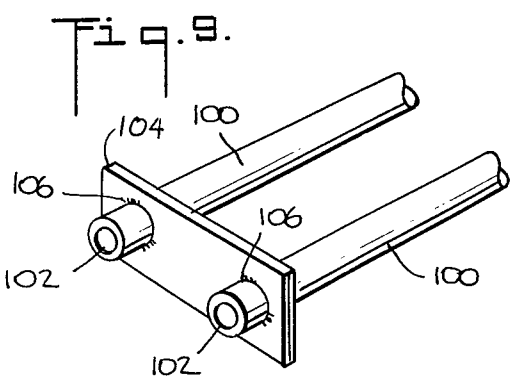
FIG. 9 is a diagrammatic view showing electrical connections for the furnace of FIG. 7.

It may happen from time to time that one or more of the tubes 36 will have to be replaced in the furnace. However, it is possible that U-shaped tubes would not be readily available; whereas straight lengths of tube could be obtained more easily. In such case the arrangement shown in FIG. 9 enables the advantages of the present invention to be obtained with straight tube lengths. As shown in FIG. 9 a pair of parallel tubes 100 are arranged in parallel side by side relationship corresponding to the relationship of the legs of the V-shaped tube portion 36a of FIG. 4. The ends of the tubes 100 opposite from connector extensions however are simply left open as indicated at 102. A connector plate 104 of the same material as the tubes 100 or of some other electrically conductive temperature resistant metal is provided with a pair of spaced openings 106 through which the ends of the tubes 100 pass. The tubes 100 are then welded or otherwise secured to the plate 104 to provide a complete circuit between the connector extension end of the tubes. The resulting assembly may then be positioned inside the furnace in the same manner as the original heating tubes. It will be appreciated that since the end of the tubes 100 are left open, no additional vent openings are required as in the preceding arrangements.

It will be appreciated that the electrically powered furnace construction described herein provides very precise and even temperature control throughout the furnace treatment region. Furnace efficiency is improved over prior gas fired furnaces and the electrically powered furnace is not restricted to stepwise or on-off type control. Moreover, the electrically powered furnace of the present invention is quiet in operation and it produces no thermal or chemical pollution. It will also be appreciated that the conversion procedure of the present invention, wherein the gas fired tubes of a controlled atmosphere furnace are used as resistance conductors for electrical heat generation, permits one to convent an existing gas fired furnace to be adapted to electrical operation with a minimum of expense and difficulty.

Having thus described the invention with particular reference to the preferred form thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by letters patent is:

1. A method of converting a fuel-fired radiant tube type furnace to electrical operation, said method comprising the steps of disconnecting from the radiant tubes of said furnace, their fuel-fired source and their exhaust, and connecting electrical supply means to the tubes to drive electrical current longitudinally through the walls of said radiant tubes.

2. A method according to claim 1 wherein said tubes are disconnected from said fuel-fired source and said exhaust by severing said tubes at locations therealong which are inside but close to the wall of said furnace.

3. A method according to claim 1 wherein said electrical supply means are connected to said radiant tubes by attaching connector extensions to the severed ends of the tubes, passing said connector extensions through said furnace wall and attaching electrical power supply conductors to said connector extensions outside the furnace walls.

4. A method according to claim 3 wherein electrically insulative bushings are inserted between said connector extensions and the furnace walls.

* * * * *